US005133802A

United States Patent [19]

Maekawa et al.

[11] Patent Number: 5,133,802

[45] Date of Patent: Jul. 28, 1992

[54] WATER AND OIL REPELLENT COMPOSITION

[75] Inventors: Takashige Maekawa, Yokohama; Masaru Nakamura, Tokyo; Masashi Matsuo, Yokohama; Mikio Sasabe, Tokyo; Hiroyuki Fujimoto, Sakurai, all of Japan

[73] Assignees: Asahi Glass Company Ltd., Tokyo; Osaka Gas Company Limited, Osaka, both of Japan

[21] Appl. No.: 514,962

[22] Filed: Apr. 26, 1990

[30] Foreign Application Priority Data

Apr. 28, 1989 [JP] Japan ..... 1-107726
Oct. 31, 1989 [JP] Japan ..... 1-282000

[51] Int. Cl.[5] ..... C09K 3/18; C08L 95/00; C09D 4/00; C09D 101/00

[52] U.S. Cl. ..... 106/2; 106/13; 106/284.2; 252/58; 428/368; 524/264

[58] Field of Search ..... 106/2, 13, 284.2; 252/58; 428/368; 524/269

[56] References Cited

U.S. PATENT DOCUMENTS

Re. 30,667 7/1981 Watanabe et al. ..... 106/2
1,915,391 7/1933 Stoops ..... 106/2
3,395,039 7/1968 Leebrick ..... 106/2
3,398,182 9/1968 Guenthner et al. ..... 106/2
3,607,747 9/1971 Ishikawa et al. ..... 252/58
3,816,229 6/1974 Bierbrauber .
3,940,359 2/1976 Chambers .
4,500,678 2/1985 Kita et al. ..... 252/58
4,639,297 1/1987 Suematsu et al. ..... 204/130
4,732,805 3/1988 Maggs .
4,931,163 6/1990 Watanabe et al. ..... 208/44

FOREIGN PATENT DOCUMENTS 0332141 9/1989 European Pat. Off. .
2016040 10/1971 Fed. Rep. of Germany .
275190 11/1987 Japan .

OTHER PUBLICATIONS

European Search Report.

*Primary Examiner*—William R. Dixon, Jr.
*Assistant Examiner*—Mellissa Bonner
*Attorney, Agent, or Firm*—Oblon, Spivak, McClelland, Maier & Neustadt

[57] ABSTRACT

A water and oil repellent composition containing, as an essential component, non-film-forming fine solid particles having a low surface tension and having a fluorine content of at least 30% by weight.

13 Claims, No Drawings

WATER AND OIL REPELLENT COMPOSITION

The present invention relates to a novel water and oil repellent composition having remarkably improved water and oil repellency, stain proofing properties and practical durability of such functions, such as abrasion resistance, washing resistance or dry cleaning resistance, and water repellency in the presence of stain.

Heretofore, a technique of treating fiber products, etc. with an organic solvent solution or an aqueous dispersion containing a perfluoroalkyl group-containing compound or a copolymer obtained by polymerizing a polymerizable monomer containing a perfluoroalkyl group, to impart water and oil repellency to the surface of such materials, has been known. This water and oil repellency is attributable essentially to formation of a surface with a low surface energy on the materials due to the surfacial orientation of the perfluoroalkyl groups. In addition to such essential function, the water and oil repellent of this type is required to have stain proofing properties and durability of such functions. Particularly, fiber products treated with conventional water and oil repellents have poor stain proofing properties, and their surface is likely to be easily stained. If such stain spreads, for instance, by abrasion to cover the entire surface, the water and oil repellency will be lost and thus lacks in a practical durability.

A technique of adding fine particles of an inorganic oxide such as silica sol to a water and oil repellent has been known and has been used for the purpose of improving the stain proofing properties (Japanese Unexamined Patent Publication No. 50079/1978). However, the fine particles used in such a method are usually solid particles having a high surface tension of at least 30 dyn/cm and hardly satisfy the practical durability intended by the present invention.

On the other hand, fine particles of fluorinated graphite have been used as a solid lubricant for the purpose of reducing frictional resistance of particles made of e.g. metals. However, there has been no instance where such fluorinated graphite particles are used for the surface treatment of fibers.

It is an object of the present invention to solve the problem of the deterioration of the water and oil repellency in the presence of stain, which is inherent to the conventional water and oil repellents composed essentially of a perfluoroalkyl group-containing polymer or low molecular weight compound.

A further object of the present invention is to provide a novel water and oil repellent composition excellent in the stain proofing properties and having remarkably improved practical durability of the water and oil repellency, such as abrasion resistance, washing resistance o dry cleaning resistance.

The present invention has been made to solve the problem inherent to the conventional water and oil repellents and provides a water and oil repellent composition containing, as an essential component, non-film-forming fine solid particles having a low surface tension or fluorinated pitch, having a fluorine content of at least 30% by weight.

Further, the present invention provides fiber products treated with such a water and oil repellent composition.

Now, the present invention will be described in detail with reference to the preferred embodiments.

As the non-film-forming fine solid particles which are an essential component of the present invention, various types of solid particles having the following properties, may be used.

The fine solid particles preferably have a critical surface tension (Zisman) of at most 25 dyn/cm, preferably at most 18 dyn/cm, more preferably about 10 dyn/cm. Further, they are fine solid particles having a fluorine content of at least 30% by weight, preferably from 30 to 65% by weight, more preferably from 50 to 65% by weight.

The solid particles having a low surface tension to be used in the present invention are in a very fine particulate form with an average particle size of at most 5 μm. They are preferably fine spherical particles with a particle size distribution of from 0.05 to 5 μm, preferably from 0.1 to 5 μm, more preferably from 0.2 to 1 μm. If the particle size distribution is outside this range, it is likely that no adequate water and oil repellency will be obtained, and the practical durability of the water and oil repellency tends to be poor. Especially when particles having an average particle size exceeding 5 μm are employed, the treated products tend to be whitened, and the commercial value will be lost.

The melting point of such fine solid particles is usually at least 100° C., preferably at least 150° C. They are preferably fine solid particles which do not undergo film-formation due to fusion of the particles among themselves even by the heat treatment at a temperature of 100° C., preferably from 150° to 200° C., because they are desired to maintain the particulate form on the surface of the fibers even when subjected to the heat treatment commonly employed for the fiber processing.

As such fine solid particles, fluorinated graphite (surface tension: about 6 dyn/cm) represented by the formula $(CF)_n$ or $(C_2F)_n$, or a fluorine-containing polymer or polycondensate (surface tension: about 12 dyn/cm) such as a perfluoroalkyl (meth)acrylate or a perfluoroalkyl group-containing silane, may be employed. Further, they may be fine solid particles obtained by treating the surface of solid particles having a high surface tension such as silica or alumina with a perfluoroalkyl group-containing compound. It is preferred to employ fluorinated graphite from the viewpoint of the water and oil repellency and easy availability.

The fluorinated pitch to be used in the present invention is a substance which is obtained by fluorinating pitch (such as isotropic pitch, mesophase pitch, hydrogenated mesophase pitch or mesocarbon microbeads) directly by fluorine gas at a temperature of from 0° to 400° C., preferably from room temperature to 150° C. and which is solid at room temperature.

The fluorinated pitch to be used in the present invention is represented by the formula $CF_x$ ($0.5 \leqq x \leqq 1.8$) and is a compound wherein from 1 to 3 fluorine atoms are firmly bonded to a carbon atom by a covalent bond.

As such fluorinated pitch, the one disclosed in Japanese Unexamined Patent Publication No. 275190/1987 may be mentioned as a representative. This fluorinated pitch has, for example, the following properties.

Fluorinated pitch composed essentially of carbon atoms and fluorine atoms, wherein the F/C atomic ratio is from 0.5 to 1.8, which shows the following properties (a), (b), (c) and (d):

(a) In the powder X-ray difraction, it shows a peak with the maximum intensity around $2\theta = 13°$ and a peak around $2\theta = 40°$ with an intensity smaller than the peak around $2\theta = 13°$.

(b) In the X-ray photoelectric spectrophotometric analysis, it shows a peak at 290.0±1.0 eV corresponding to a CF group and a peak around 292.5±0.9 eV corresponding to a $CF_2$ group, whereby the ratio in the intensity of the peak corresponding to the $CF_2$ group to the peak corresponding to the CF group is from 0.15 to 1.5.

(c) It is capable of forming a thin film by vacuum vapor deposition.

(d) Its contact angle to water at 30° C. is 141°±8°. Such a solid has a low critical surface tension.

The fluorinated pitch to be used here is preferably a compound which is solid at room temperature and which usually has a fluorine content of from 45 to 75% by weight, more preferably from 50 to 75% by weight, in order to obtain a low surface tension. For example, the one having a fluorine content of 67% by weight, has a critical surface tension of at most 25 dyn/cm.

Further, the decomposition point of this fluorinated pitch is suitably at least 100° C., preferably at least 150° C., because it is required not to decompose by the heat treatment commonly employed in the fiber processing.

As such a fluorinated pitch composition, it is possible to synthesize compounds of various compositions represented generally by the formula ($CF_x$) depending upon the synthetic conditions. As a conventional compound having the formula ($CF_x$), fluorinated graphite obtained by fluorinating graphite, is known. This fluorinated pitch has an excellent characteristic that it is soluble in a fluorine-type solvent such as a fluorinated aromatic compound such as perfluorobenzene, a perfluoro amine or a perfluoro ether.

As the water and oil repellent useful in combination with the fluorinated pitch in the present invention, conventional water and oil repellents containing a fluorine-type or silicon-type polymer, or a low molecular weight compound, may be used without any particular restriction.

For example, as the fluorine-type polymer, a copolymer composed essentially of monomers having a perfluoroalkyl group and an ethylenically unsaturated bond, may be mentioned. As the silicon-type polymer, a polydimethylsilicon homopolymer or a trifluoromethylene group- or perfluoroalkyl group-containing silicon polymer may be mentioned. As the low molecular weight compound, a fluorine-containing urethane or a urea compound obtained by the reaction of a perfluoroalkyl group-containing compound containing active hydrogen with an isocyanate compound, may be mentioned.

As the monomer having a perfluoroalkyl group and an ethylenically unsaturated bond, the following compounds may be mentioned:

$CF_3(CF_2)_4CH_2OCOC(CH_3)=CH_2$ $CF_3(CF_2)_6(CH_2)_2OCOC(CH_3)=CH_2$ $CF_3(CF_2)_7CH_2CH_2OCOCH=CH_2$ $(CF_3)_2CF(CF_2)_5(CH_2)_2OCOCH=CH_2$ $CF_3(CF_2)_7SO_2N(C_3H_7)(CH_2)_2OCOCH=CH_2$ $CF_3(CF_2)_7(CH_2)_4OCOCH=CH_2$ $CF_3(CF_2)_7SO_2N(CH_3)(CH_2)_2OCOC(CH_3)=CH_2$

-continued $CF_3(CF_2)_7SO_2N(C_2H_5)(CH_2)_2OCOCH=CH_2$ $CF_3(CF_2)_7CONH(CH_2)_2OCOCH=CH_2$ $(CF_3)_2CF(CF_2)_6(CH_2)_3OCOCH=CH_2$ $(CF_3)_2CF(CF_2)_6CH_2CH(OCOCH_3)OCOC(CH_3)=CH_2$ $(CF_3)_2CF(CF_2)_6CH_2CH(OH)CH_2OCOCH=CH_2$ $CF_3(CF_2)_8(CH_2)_2OCOCH=CH_2$ $CF_3(CF_2)_8(CH_2)_2OCOC(CH_3)=CH_2$ $CF_3(CF_2)_8CONH(CH_2)_2OCOC(CH_3)=CH_2$ $(CF_2Cl)(CF_3)(CF_2)_7CONH(CH_2)_2OCOCH=CH_2$ $H(CF_2)_{10}CH_2OCOCH=CH_2$ $CF_2Cl(CF_2)_{10}CH_2OCOC(CH_3)=CH_2$ $CF_3(CF_2)_5CH_2CH_2OCH_2CH_2OCH=CH_2$ $(CF_2Cl)(CF_3)CF(CF_2)_7CH_2CH_2OCH_2CH_2OCH=CH_2$ $CF_3(CF_2)CH_2CH(OH)CH_2OCH_2CH_2OCH=CH_2$ As compounds copolymerizable with the above monomers, the following compounds may be mentioned, and they may be copolymerized in a proportion of from 10 to 90% by weight, preferably from 20 to 80% by weight, to form water and oil repellents which are useful in combination for the composition of the present invention.

They include, for example, ethylene, vinyl acetate, vinyl chloride, vinyl fluoride, vinylidene halide, styrene, α-methylstyrene, p-methylstyrene, acrylic acid and its alkyl ester, methacrylic acid and its alkyl ester, poly(oxyalkylene)(meth)acrylate, (meth)acrylamide, diacetone (meth)acrylamide, methylol-modified diacetone meth)acrylamide, N-methylol(meth)acrylamide, vinyl alkyl ether, halogenated alkyl vinyl ether, vinyl alkyl ketone, butadiene, isoprene, chloroprene, glycidyl (meth)acrylate, 2-hydroxyethyl (meth)acrylate, aziridinylethyl (meth)acrylate, benzyl (meth)acrylate, isocyanate ethyl (meth)acrylate, cyclohexyl (meth)acrylate, 2-ethylhexyl (meth)acrylate, maleic anhydride, aziridinyl (meth)acrylate, polysiloxane-containing (meth)acrylate and n-vinyl carbazole.

The concentration of the solid component in the water and oil repellent composition is preferably from 5 to 30% by weight, more preferably from 10 to 25% by weight, from the viewpoint of the storage stability of the liquid and the convenience in use.

To be used for the treatment of an article such as a fiber article, the solvent or aqueous dispersion is diluted for use. The treating solution is adjusted to have a concentration of the solid content within a range of from 0.1 to 3.0% by weight, preferably from 0.2 to 2.0% by weight. In the solid content, the weight ratio of the non-film-forming fine solid particles having a low surface tension or fluorinated pitch to the conventional water and oil repellent is usually within a range of from 100/0 to 20/80, preferably from 95/5 to 30/70. If the fine solid particles or fluorinated pitch is used alone, the drape and handle of the treated product tend to be coarse. On the other hand, if the amount is too small, the water-repellency after staining and abrasion tends to be lost.

There is no particular restriction as to the articles to be treated by the water and oil repellent composition of the present invention. Various examples may be mentioned, including fiber fabrics, glass, paper, wood, leather, fur, asbestos, ceramics, bricks, cement, metals and oxides, porcelains, plastics, coated surfaces and plasters. The fiber fabrics may be made of animal or plant natural fibers such as cotton, hemp, wool or silk, various synthetic fibers such as polyamide, polyester, polyvinyl alcohol, polyacrylonitrile, polyvinyl chloride or polypropylene, semisynthetic fibers such as rayon or acetate, inorganic fibers such as glass fibers or asbestos fibers, or blends of these fibers.

The fiber product treated with the water and oil repellent composition containing, as an essential component, non-film-forming fine solid particles having a low surface tension according to the present invention, has particularly excellent water-repellency, since the monofilament surfaces have fine concaves and convexes corresponding to the particle sizes of the fine particles. Further, when the fine particles are used in combination with a perfluoroalkyl group-containing polymer or compound, the fine particles will be bonded by such polymer or compound layer, whereby the oil repellency and the durability will be improved. The interaction between the above polymer or compound layer an the fine particles may be a chemical bond or a physical bond such as adsorption.

Likewise, a fiber product treated with the water and oil repellent composition containing fluorinated pitch is believed to have excellent water-repellency, since fine concaves and convexes of fluorinated pitch are densely formed on the monofilament surfaces of the treated fiber product. Further, when the fluorinated pitch and a perfluoroalkyl group-containing polymer or compound are used as dissolved in a fluorine-type solvent such as a perfluoro amine or a perfluoro ether, fine particles of the fluorinated pitch will be present in a dispersed state in the polymer or compound layer, whereby the water repellency and the durability against e.g. dry cleaning will be improved. The interaction between the polymer or compound layer and the fine particles dispersed in the layer may be a chemical bond or a physical bond such as adsorption.

Various formulations may be employed for the water and oil repellent composition of the present invention, including an aqueous dispersion, a dispersion in an organic solution, a two-step treatment or a spray formulation of the fine solid particles and the perfluoroalkyl group-containing water and oil repellent.

The water and oil repellent composition containing non-film-forming fine solid particles having a low surface tension or fluorinated pitch according to the present invention and an article treated therewith are believed to provide excellent water repellency, because fine concaves and convexes having a low surface tension are formed on the surface of the treated article, and a composite interface of gas-solid-liquid will be formed with water drops or oil drops. Further, when used as dispersed in a certain specific solvent, it is possible to make the dispersed state of fine particles uniform. Further, it is believed that the fine concaves and convexes serve to reduce the friction coefficient among fibers, whereby falling off of the water-repellent film layer due to abrasion, is reduced.

Now, the present invention will be described in further detail with reference to Examples. However, it should be understood that the present invention is by no means restricted by such specific Examples.

| Fluorinated graphite | Average particle size (μm) | Fluorine content (wt %) |
|---|---|---|
| A | 0.5 | 65 |
| B | 1.0 | 65 |
| C | 0.5 | 10 |

By using the above fluorinated graphite as fine solid particles having a low surface tension, the following treating bath was prepared, and a nylon cloth was thereby treated.

EXAMPLE 1

A nylon fabric (monofilaments: 10 μm) was dipped into a treating bath (R-113) containing 0.12% by weight of fluorinated graphite and 0.37% by weight of AG650 (solvent-type water and oil repellent, manufactured by Asahi Glass Company Ltd.), then dried in air and dried in a hot air dryer at 130° C. for 3 minutes. At that time, WOR=60/100. To this fabric, a stain prepared by mixing liquid paraffin and cigarette ash in a weight ratio of 10/1, was dropped and abraded by a pilling tester. Then, water was further dropped and abraded.

After drying in air, the water repellency was measured and found to be 80+.

EXAMPLES 2 TO 7

The treatment and evaluation were conducted in the same manner as in Example 1 except that the composition of the bath comprising fluorinated graphite and AG650 was changed as shown in Table 1.

COMPARATIVE EXAMPLES 1 AND 2

The treatment and evaluation were conducted in the same manner as in Example 1 except that fluorinated graphite having a small fluorine content as identified in Table 1 was used, or no fluorinated graphite was incorporated. In these cases, the water repellency after staining was poor as compared with the preceding Examples.

TABLE 1

| | | Examples | | | | | | | Comparative Examples | |
|---|---|---|---|---|---|---|---|---|---|---|
| | | 1 | 2 | 3 | 4 | 5 | 6 | 7 | 1 | 2 |
| Fluorinated graphite (wt %) | A | 0.12 | 0.25 | 0.37 | 0.40 | — | 0.50 | 1.0 | — | — |
| | B | — | — | — | — | 0.37 | — | — | — | — |
| | C | — | — | — | — | — | — | — | 0.37 | — |
| Fluorine-type polymer (wt %) | AG650 | 0.37 | 0.25 | 0.12 | 0.10 | 0.12 | — | — | 0.12 | 0.50 |
| Initial water repellency | | 100 | 100 | 100 | 100 | 80+ | 100 | 100 | 70+ | 100 |
| Water repellency after staining | | 80+ | 90− | 90− | 90− | 70+ | 80+ | 90− | 0 | 50+ |

The concentration in the treating solution is the concentration of the effective solid content. The concentration of the effective solid content of AG650 is 10%.

EXAMPLE 8

A nylon fabric (monofilaments: 10 μm) was dipped into a treating bath (R-113) containing 0.12% by weight of fluorinated pitch (fluorine content: 66% by weight) and 0.37% by weight of the fluorine-type copolymer as identified in Table 2, then dried in air and dried in a hot air dryer at 130° C. for 3 minutes.

At that time, WR (water repellency)/OR (oil repellency)=100/6.

To this fabric, a stain prepared by mixing liquid paraffin and cigarette ash in a weight ratio of 10:1, was dropped and abraded by a pilling tester. Then, water as further dropped and abraded.

After drying in air, the water repellency was measured and found to be 80+ (the water repellency after staining).

Further, this stained cloth was subjected to dry cleaning with perchloroethylene, and the water repellency after drying in air was measured, whereby the water repellency of 70+ (water repellency after staining and dry cleaning) was maintained.

EXAMPLES 9 TO 13

The treatment and evaluation were conducted in the same manner as in Example 8 except that the composition of the bath comprising the fluorinated pitch and the fluorine-type copolymer, was changed as shown in Table 2.

COMPARATIVE EXAMPLE 3

The treatment and evaluation were conducted in the same manner as in Example 8 except that no fluorinated pitch was incorporated as shown in Table 2. In this case, the water repellency after staining and the water repellency after staining and dry cleaning were poor as compared with the Examples.

EXAMPLE 14

Fluorinated pitch (fluorine content: 66% by weight) was dissolved in perfluorotributyl amine (Aflude E-18, tradename, manufactured by Asahi Glass Company Ltd.) to obtain solutions having solid content concentrations of 0.2% by weight, 0.5% by weight and 1.0% by weight, respectively. A nylon cloth was treated with each solution. The initial water repellency, the water repellency after staining and the water repellency after dry cleaning were 100, 90 and 80, respectively, in each case. Further, the treated cloth was observed by an electron microscope, whereby it was observed that even in a low concentration region with a solid content concentration of 0.2% by weight, fine concaves and convexes of fluorinated pitch were densely formed on the fibers.

PREPARATION EXAMPLE 1

Fluorinated pitch (fluorine content: 66% by weight) was dissolved in perfluorotributyl amine (Aflude E-18, tradename, manufactured by Asahi Glass Company Ltd.) to obtain a solution having a solid content concentration of 1.0% by weight. To 100 parts of this solution, 5 parts of Emulgen 950 (nonionic emulsifier, manufactured by Kao Corporation), 1 part of an acetate of Fermine DMC (cationic emulsifier, manufactured by Kao Corporation) and 300 parts of water were added, and the mixture was stirred 3,000 times for 1 minute by a homomixer and then treated by a high pressure homogenizer. The emulsion thereby obtained was milky white and stable for more than 1 day.

PREPARATION EXAMPLE 2

To 100 parts of a perfluorotributyl amine solution containing 1% by weight of fluorinated pitch (fluorine content: 66% by weight), 4 parts of Reodol TW-L120 (nonionic emulsifier, manufactured by Kao Corpora-

TABLE 2

| | Examples | | | | | | Comparative |
|---|---|---|---|---|---|---|---|
| | 8 | 9 | 10 | 11 | 12 | 13 | Example 3 |
| Fluorinated pitch (wt %) | 0.12 | 0.25 | 0.37 | 0.40 | 0.50 | 1.0 | — |
| Fluorine-type copolymer (wt %) | 0.37 | 0.25 | 0.12 | 0.10 | — | — | 0.50 |
| Initial water repellency | 100 | 100 | 100 | 100 | 100 | 100 | 100 |
| Water repellency after staining | 80+ | 90− | 90− | 90− | 80+ | 90− | 50+ |
| Water repellency after staining and dry cleaning | 70+ | 70− | 80− | 80− | 80− | 80+ | 50− |

The concentration in the treating solution is the concentration of the effecting solid content. The concentration of the effective solid content of the fluorine-type copolymer was 10%.

*Composition of the fluorine-type copolymer: a perfluoroalkylate/stearyl acrylate/glycidyl methacrylate = 40/30/30/ (wt %) were subjected to solution polymerization in 1,1,2-trichlorotrifluoroethane.

tion), 2 parts of an acetate of Fermine D86 (cationic emulsifier, manufactured by Kao Corporation) and 300 parts of water were added, and the mixture was stirred 3,000 times for 1 minute by a homomixer and then treated by a high pressure homogenizer. The emulsion thereby obtained was milky white and stable for more than 1 day.

EXAMPLES 15 AND 16

A nylon cloth was treated with the emulsion obtained by Preparation Example 1 or 2. The nylon cloth was dipped in the emulsion and squeezed to have a pick up of 60% by weight, and then subjected to heat treatment at 110° C. for 90 seconds and 170° C. for 60 seconds.

The initial water repellency, the water repellency after staining and the water repellency after dry cleaning were 100, 90 and 80, respectively, in each case.

The article treated by the water and oil repellent composition containing fine solid particles having a low surface tension of fluorinated pitch according to the present invention, presents excellent water repellency not only at the initial stage but even in the presence of a stain on the surface, since fine concaves and convexes having a low surface tension are formed on its surface and a composite interface of gas-solid-liquid is formed with water drops or with the stain. Further, when the fluorinated pitch is dissolved in a certain specific fluorine-type organic solvent and then applied to the surface of the object, formed fine concaves and convexes will be more uniform, and the water repellency and its durability can be improved.

We claim:

1. A water and oil repellent composition comprising, as an essential component, fluorinated pitch having a fluorine content of 45 to 75% by weight dissolved in a fluorine-containing solvent.

2. The composition according to claim 1, wherein the fluorine-containing solvent is a fluorine-type aromatic compound, a perfluoro amine or a perfluoro ether.

3. A water and oil repellent composition comprising a fluorinated pitch having a fluorine content of 45 to 75% by weight, and a perfluoroalkyl group-containing polymer or compound in a weight ratio of the fluorinated pitch to the perfluoroalkyl group-containing polymer or compound within the range of from 95/5 to 20/80.

4. The composition according to claim 3, wherein the weight ratio of the fluorinated pitch to the perfluoroalkyl group-containing polymer or compound is within the range of from 95/5 to 30/70.

5. The composition according to claim 3, wherein the surface tension of the fluorinated pitch is at most 25 dyn/cm.

6. The composition according to claim 3, the decomposition temperature of the fluorinated pitch is at least 100° C.

7. The composition according to claim 3, wherein the fluorinated pitch is dispersed in water or in an organic solvent.

8. The composition according to claim 7, wherein the organic solvent is a fluorine-containing solvent.

9. The composition according to claim 4, wherein the fluorinated pitch is dispersed in water or in an organic solvent.

10. A fiber product treated with fluorinated pitch having a fluorine content of from 45 to 75% by weight and a perfluoroalkyl group-containing polymer or compound in a weight ratio of the fluorinated pitch to the perfluoroalkyl group-containing polymer or compound within the range of from 95/5 to 20/80.

11. The fiber according to claim 10, wherein the weight ratio of the fluorinated pitch to the perfluoroalkyl group-containing polymer or compound is within the range of from 95/5 to 30/70.

12. The fiber according to claim 10, wherein the surface tension of the fluorinated pitch is at most 25 dyn/cm.

13. The fiber according to claim 10, wherein the decomposition temperature of the fluorinated pitch is at least 100° C.

* * * * *